US008881902B2

(12) United States Patent
Bulls, Jr.

(10) Patent No.: US 8,881,902 B2
(45) Date of Patent: Nov. 11, 2014

(54) PACKAGING ASSEMBLY

(75) Inventor: Carl A. Bulls, Jr., Brooklyn Park, MN (US)

(73) Assignee: Target Brands, Inc., Minneapolis, MN (US)

( * ) Notice: Subject to any disclaimer, the term of this patent is extended or adjusted under 35 U.S.C. 154(b) by 781 days.

(21) Appl. No.: 13/024,306

(22) Filed: Feb. 9, 2011

(65) Prior Publication Data

US 2012/0199637 A1 Aug. 9, 2012

(51) Int. Cl.
*B65D 85/48* (2006.01)
*B65D 71/58* (2006.01)

(52) U.S. Cl.
CPC .. *B65D 71/0022* (2013.01); *B65D 2571/00339* (2013.01); *B65D 2571/00487* (2013.01); *B65D 2571/0066* (2013.01); *B65D 2571/00796* (2013.01); *B65D 2571/0082* (2013.01); *B65D 2571/00987* (2013.01)
USPC ..... 206/449; 206/576

(58) Field of Classification Search
USPC ..... 206/170, 162, 171, 172, 174, 175, 198, 206/139, 445, 449, 454, 806, 150, 463, 303, 206/576, 577; 229/118, 117.18, 117.14, 229/120.02, 120.08, 120.13, 120.18, 229/120.24, 120.17; 53/528, 139.1, 176, 53/399, 594, 591, 590, 592, 588, 585, 582, 53/589; 294/31.2, 119.2
See application file for complete search history.

(56) References Cited

U.S. PATENT DOCUMENTS

D146,246 S 1/1947 Bureau
D166,368 S 4/1952 Wenander
2,830,727 A * 4/1958 Stoel ..... 206/198
3,069,979 A * 12/1962 Charles et al. ..... 493/136
3,220,684 A 11/1965 Milne
3,497,057 A 2/1970 Traner et al.
3,547,339 A * 12/1970 Bruce ..... 229/117.15
3,804,311 A 4/1974 Oglesbee
3,861,578 A 1/1975 McHan
D236,577 S 9/1975 Press
4,250,992 A * 2/1981 Gilbert ..... 206/162

(Continued)

FOREIGN PATENT DOCUMENTS

CA 2572721 A1 8/2007
GB 787525 12/1957

(Continued)

OTHER PUBLICATIONS

Office Action from Canadian patent Application No. 2,762,240, mailed Aug. 13, 2012 (5 pages).

(Continued)

*Primary Examiner* — Jacob K Ackun
*Assistant Examiner* — Jenine Pagan
(74) *Attorney, Agent, or Firm* — Griffiths & Seaton PLLC; JoAnn M. Seaton

(57) ABSTRACT

A packaging assembly includes a base and a divider. The base includes a bottom piece and first, second, third, and fourth walls extending from the bottom piece. The bottom piece of the base and the first, second, third, and fourth walls of the base define a product receptacle. The divider is connected to the bottom piece of the base and extends through the product receptacle. The base and the divider are jointly formed from an integral planar member having a plurality of folds therein. Other products, assemblies, and associated methods are also disclosed.

21 Claims, 16 Drawing Sheets

(56) References Cited

U.S. PATENT DOCUMENTS

| | | | | | |
|---|---|---|---|---|---|
| D358,740 | S | | 5/1995 | Ancona et al. | |
| 5,607,056 | A | * | 3/1997 | Whiteside | 206/427 |
| 5,848,695 | A | * | 12/1998 | Harris et al. | 206/427 |
| 5,871,090 | A | * | 2/1999 | Doucette et al. | 206/170 |
| D408,228 | S | | 4/1999 | Tisdale | |
| D418,023 | S | | 12/1999 | Robinson | |
| 6,454,107 | B1 | | 9/2002 | Belanger et al. | |
| D531,459 | S | | 11/2006 | Hastings | |
| 7,445,120 | B2 | * | 11/2008 | Brej | 206/747 |
| 7,481,313 | B1 | | 1/2009 | Kramedjian et al. | |
| D600,549 | S | | 9/2009 | Anderson et al. | |
| D602,353 | S | | 10/2009 | Anderson et al. | |
| D617,637 | S | | 6/2010 | Anderson et al. | |
| 2002/0029995 | A1 | | 3/2002 | Garrett | |

FOREIGN PATENT DOCUMENTS

| | | | |
|---|---|---|---|
| JP | 5305939 | | 11/1993 |
| JP | 2006076612 | A | 3/2006 |
| JP | 2006076612 | A1 | 3/2006 |
| WO | 2007116087 | A1 | 10/2007 |

OTHER PUBLICATIONS

Office Action from Canadian Patent Application No. 2,762,240, mailed Jan. 10, 2013 (5 pages).

Office Action from Canadian Patent Application No. 2,762,240, mailed Mar. 27, 2012 (3 pages).

www.alibaba.com, MDF Coster HL-CC032, publicly available at least as early as Sep. 1, 2010, 2 pages.

www.alibaba.com, Natural Cork Coaster, publicly available at least as early as Sep. 1, 2010, 2 pages.

www.alibaba.com, Leather Coaster, publicly available at least as early as Sep. 1, 2010, 2 pages.

Photograph of Michael Graves Bamboo Coaster Packaging, available in Target stores beginning Feb. 2010, 1 page.

* cited by examiner

PACKAGING ASSEMBLY

BACKGROUND OF THE INVENTION

Retailers are continually evolving product packaging in hopes of discovering more effective, visually attractive, and economical assemblies for packaging and displaying products to potential consumers.

SUMMARY OF THE INVENTION

One aspect of the present invention relates to a packaging assembly for packaging and displaying one or more products in a retail display. The packaging assembly includes a base and a divider. The base includes a bottom piece and first, second, third, and fourth walls extending from the bottom piece. The bottom piece of the base and the first, second, third, and fourth walls of the base define a product receptacle. The divider is connected to the bottom piece of the base and extends through the product receptacle. The base and the divider are jointly formed from an integral planar member having a plurality of folds therein.

The integral planar member may include a central portion and first, second, third, and fourth folding portions extending from a periphery of the central portion. The first and second folding portions of the integral planar member may be folded toward the central portion of the integral planar member to jointly form the divider. The first folding portion of the integral planar member may at least partially form the first wall of the base, and the second folding portion of the integral planar member may at least partially form the second wall of the base. The third and fourth folding portions of the integral planar member may be folded toward the central portion of the integral planar member such that the third folding portion of the integral planar member at least partially forms the third wall of the base and the fourth folding portion of the integral planar member at least partially forms the fourth wall of the base. Other embodiments of product and packaging assemblies and associated methods are also disclosed.

BRIEF DESCRIPTION OF THE DRAWINGS

Embodiments of the invention will be described with respect to the figures, in which like reference numerals denote like elements, and in which.

DETAILED DESCRIPTION

Figure 1:
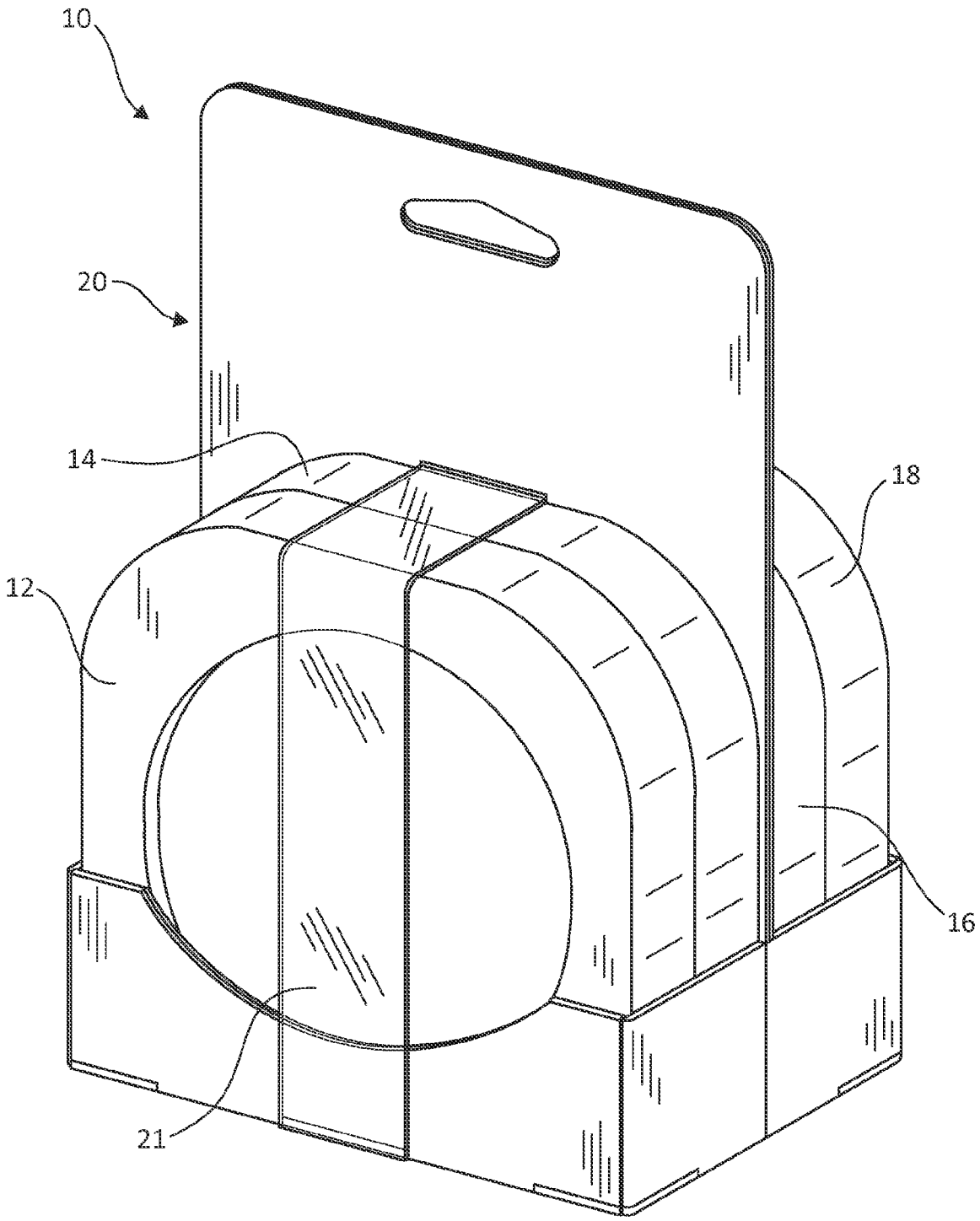
FIG. 1 is a front, perspective view illustrating a product assembly, according to one embodiment of the present invention.
Figure 2:
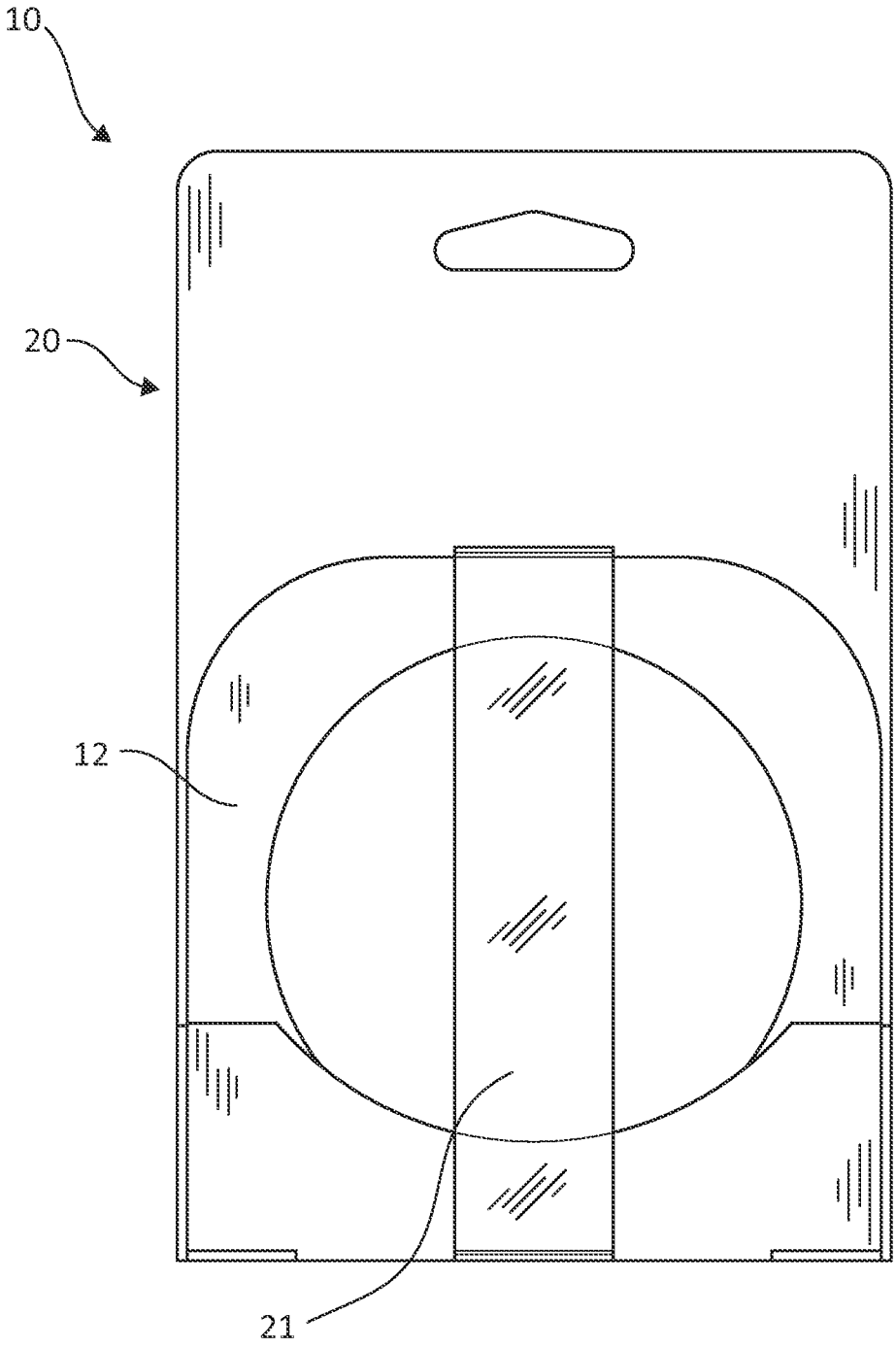
FIG. 2 is a front view of the product assembly of FIG. 1.
Figure 3:
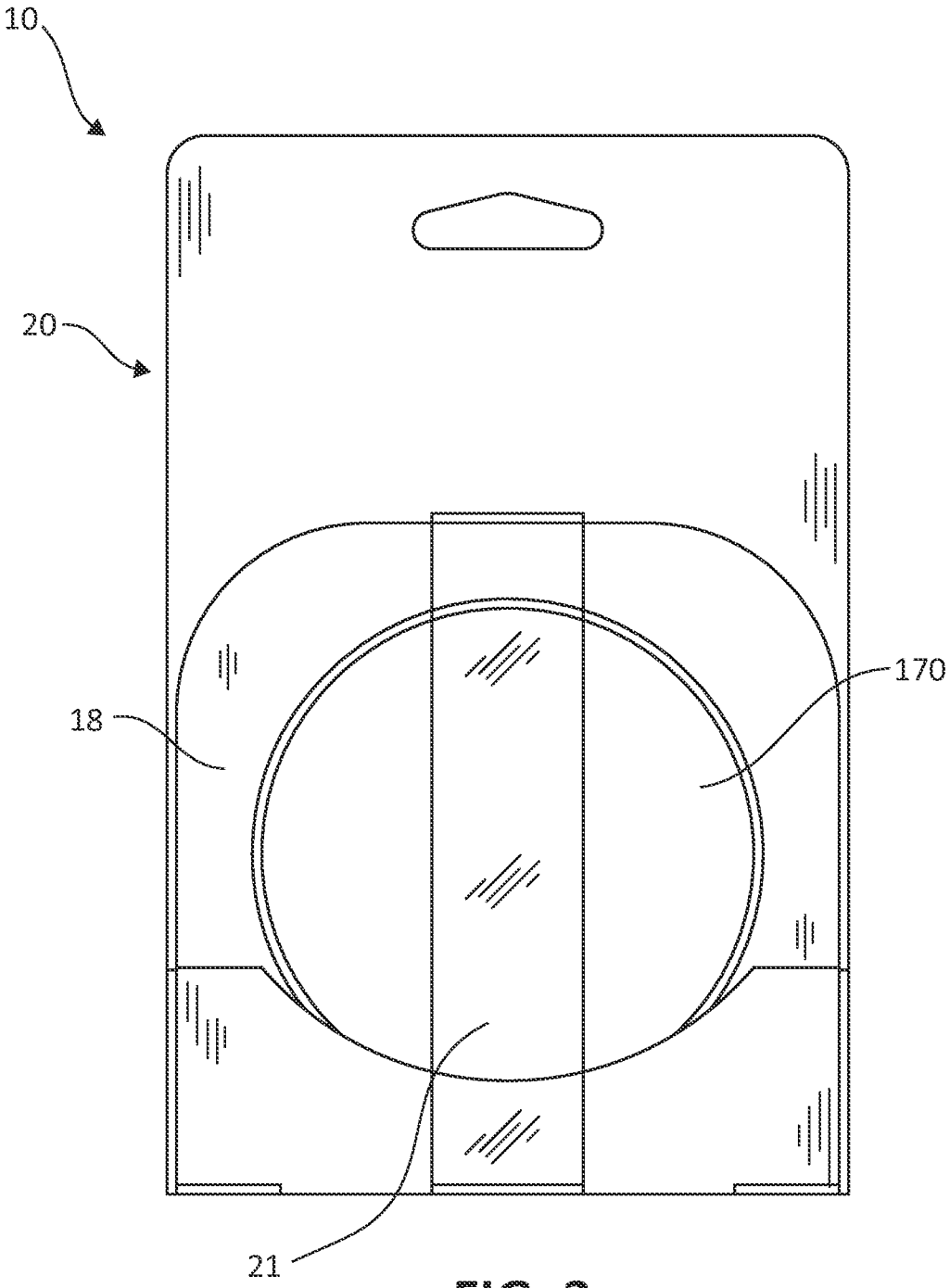
FIG. 3 is a back view of the product assembly of FIG. 1.
Figure 4:
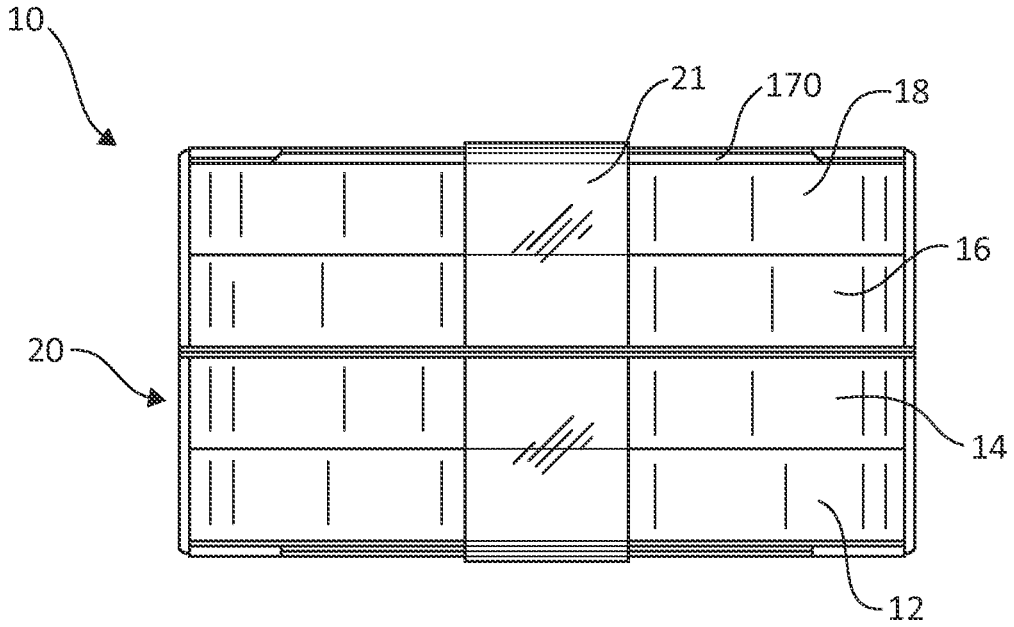
FIG. 4 is a top view of the product assembly of FIG. 1.
Figure 5:
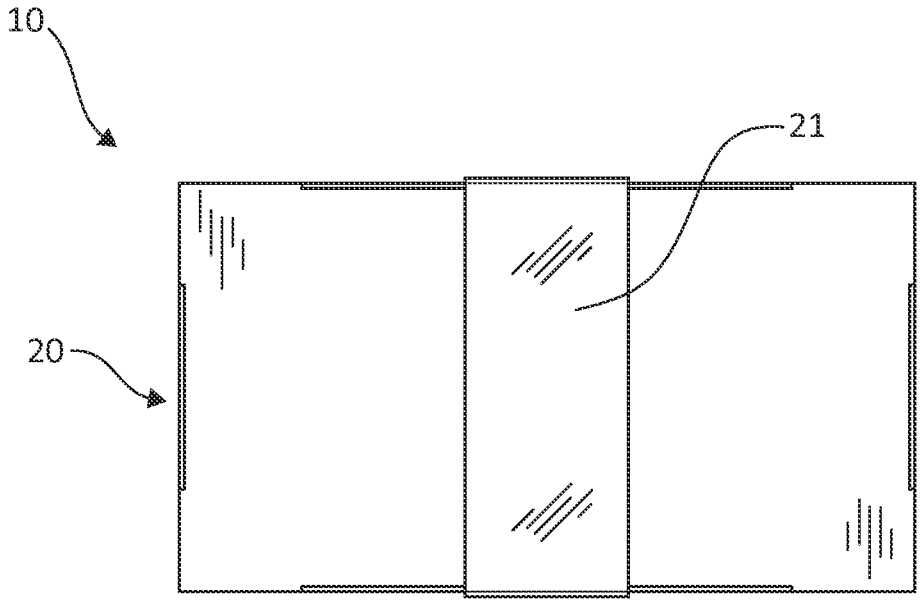
FIG. 5 is a bottom view of the product assembly of FIG. 1.
Figure 6:
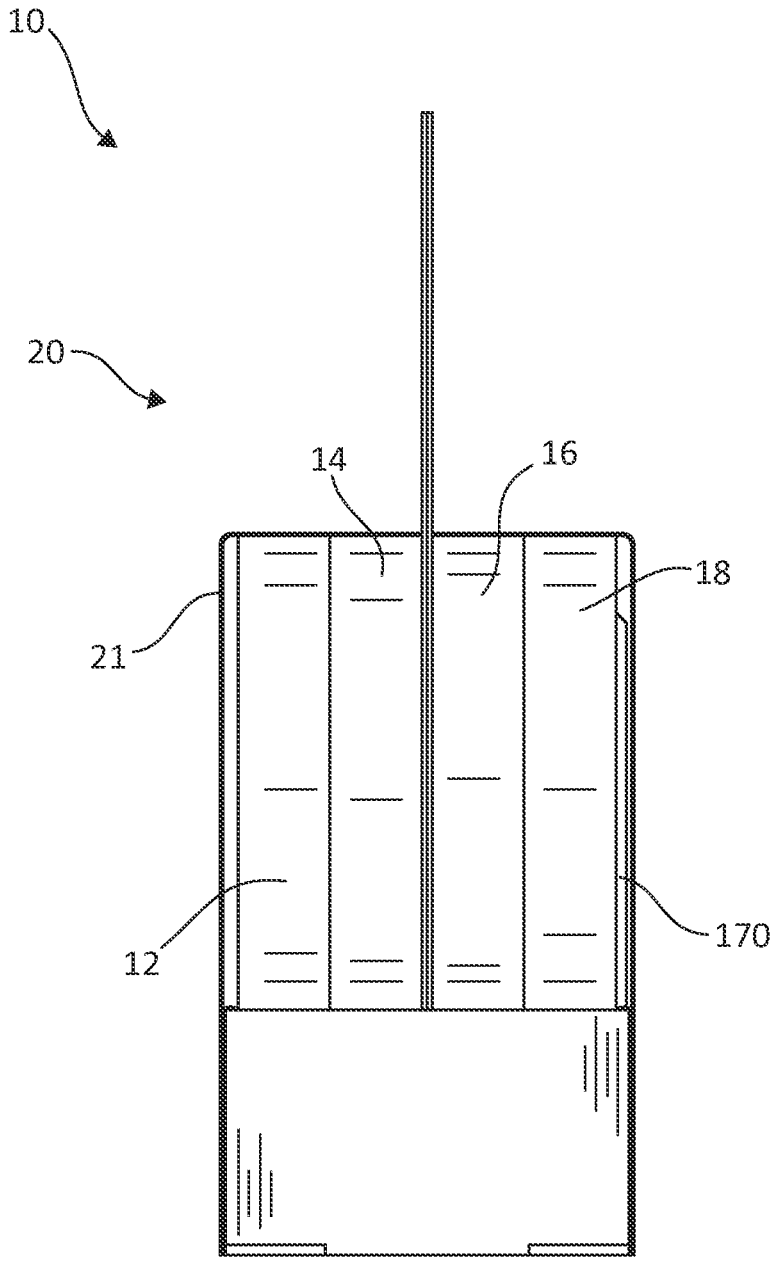
FIG. 6 is a right side view of the product assembly of FIG. 1, the left side view being a mirror image thereof.

Embodiments of the present invention are configured to package and display one or more products in a retail display, for example, via suspension from a hanger on a sales rack, and form a packaging assembly suitable for such packaging and displaying of the one or more products. More specifically, a packaging assembly is provided for packaging and displaying one or more products in a retail display. The packaging assembly includes a base and a divider. In one embodiment, the base includes a bottom piece and first, second, third, and fourth walls extending from the bottom piece. The bottom piece of the base and the first, second, third, and fourth walls of the base define a product receptacle. The divider is connected to the bottom piece of the base and extends through the product receptacle. In one example, the base and the divider are jointly formed from an integral planar member having a plurality of folds therein. In one embodiment, the divider includes one or more openings for suspending the packaging assembly, and thus the product(s) in the product receptacle, from a retail assembly, such as from a hanger or hook. As a result, the packaging assembly provides an effective and economical means for packaging and displaying objects. Other related products, assemblies and methods are also disclosed and provide additional advantages.

Turning now to FIGS. 1-6, a product assembly 10 according to one embodiment of the present invention is illustrated. The product assembly 10 includes products 12, 14, 16, and 18, a packaging assembly (or product container) 20, and a band 21. In the one embodiment, the products are substantially similar to one another, are stackable, and/or are each substantially planar members, such as the coasters depicted in FIGS. 1-6. As is evident from FIGS. 1-6, the band 21 secures the products 12, 14, 16, and 18 to or within the packaging assembly 20.

FIGS. 7-11 illustrate the packaging assembly 20 without the products 12, 14, 16, and 18 secured thereto. The packaging assembly 20 includes a base (or carton) 22 and a divider (or hanging member) 24. The base 22 includes a bottom piece 26 (FIGS. 9 and 10), along with side walls (or panels) 28 and 30 and end walls 32 and 34 that extend upwards around a periphery of the bottom piece 26 to form a product receptacle 36. In one example, the side walls 28 and 30 are positioned opposite (i.e., on opposing sides of the bottom piece 26) and extend substantially parallel to one another, and/or the end walls 32 and 34 are positioned opposite (i.e., on opposing ends of the bottom piece 26) and extend substantially parallel to one another. In one embodiment, the side walls 28 and 30 and the end walls 32 and 34 each extend substantially perpendicular to the bottom piece 26. In the embodiment shown, the bottom piece 26, as well as the product receptacle 36, is substantially rectangular in shape, and the side walls 28 and 30 are shaped to have cutouts or depressions 38 and 40, respectively, therein.

In one embodiment, the divider 24 extends upwards from the bottom piece 26 of the base 22 (and/or through the product receptacle 36), spans between the end walls 32 and 34 such that it is substantially parallel to the side walls 28 and 30 (and substantially perpendicular to the end walls 32 and 34), and divides the product receptacle 36 into two substantially equal portions or chambers. In one example, the divider 24 is substantially rectangular in shape and/or has openings 42, 44, and 46 extending therethrough. In one embodiment, the divider 24 extends a distance or height above the bottom piece 26 of the base 22 that is at least twice that of side walls 28 and 30 and end walls 32 and 34.

Figure 12:
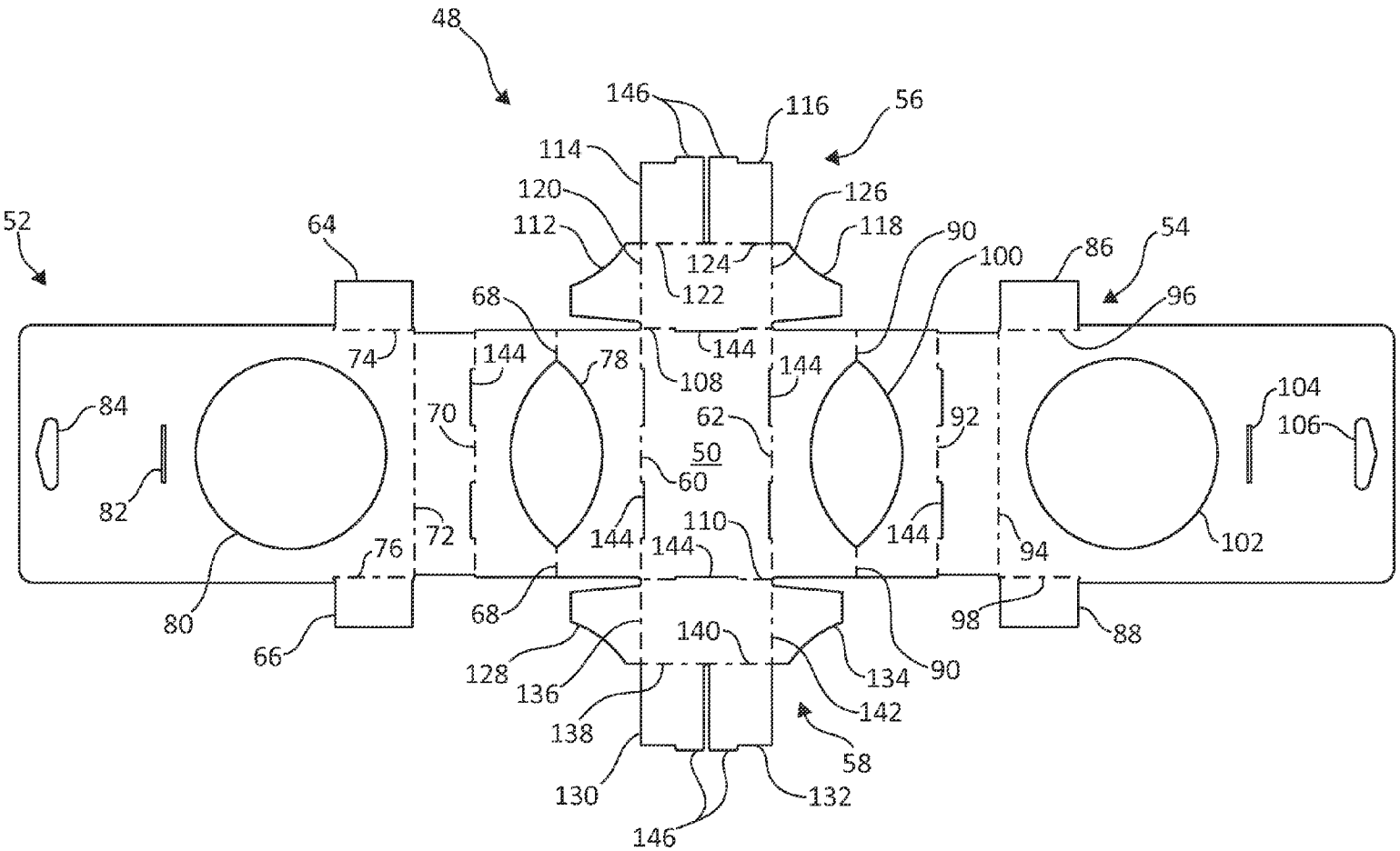
FIG. 12 is a top view illustrating an integral planar member in an unfolded state according to one embodiment of the present invention, which may be used to form the packaging assembly of FIG. 7.

Referring now to FIG. 12, a planar member 48 is illustrated, which, in one embodiment, is used to form the package assembly 20 shown in FIGS. 7-11. In one embodiment, the planar member 48 (as well as the entire package assembly 20) is made of a single, integral piece or sheet of material, such as cardboard, paperboard, chipboard, or other suitable substantially planar material. The planar member 48 includes a central portion (or midsection) 50, side portions 52 and 54 (or first and second folding portions), and end portions 56 and 58 (or third and fourth folding portions). In one embodiment, the central portion 50 is substantially rectangular in shape and has dimensions similar to that of the bottom piece 26 (FIGS. 9 and 10) of the base 22 (FIGS. 1-11) of the packaging assembly 20.

As shown in FIG. 12, the side portions 52 and 54 extend from opposing sides of the central portion 50 away from one another and are connected to the central portion 50 at fold lines 60 and 62, respectively. In one embodiment, the side portions 52 and 54 are substantially rectangular and are "mirror images" of each other (i.e., the side portions 52 and 54 are substantially identical). Side portion 52 includes flaps 64 and 66 extending from a mid-portion thereof and fold lines 68, 70, 72, 74, and 76. Side portion 52 also has apertures 78, 80, 82, and 84 extending therethrough. As will be made clear below, apertures 80, 82, and 84 correspond to and at least partially form openings 42, 44, and 46 in the divider 24 (FIGS. 7-11), and aperture 78 corresponds to and defines depression 38.

As shown, fold lines 68, 70, and 72 extend substantially parallel to one another and are positioned at progressively larger distances from the central portion 50. Fold lines 74 and 76 are opposite and substantially parallel to one another and are substantially perpendicular to fold lines 68, 70, and 72 and are opposite and substantially parallel to one another. The aperture 78 is positioned between fold lines 60 and 70 and is substantially bisected by fold line 68. Apertures 80, 82, and 84 are positioned at progressively larger distances from the central portion 50.

Similar to side portion 52, in one embodiment, side portion 54 includes flaps 86 and 88 extending from a mid-portion thereof and fold lines 90, 92, 94, 96, and 98, as well as apertures 100, 102, 104, and 106 extending therethrough, which also correspond to and at least partially define openings 42, 44, and 46 in the divider 24, and aperture 100 corresponds to and defines depression 40. Fold lines 90, 92, and 94 extend substantially parallel to one another and are positioned at progressively larger distances from the central portion 50. Fold lines 96 and 98 are opposite and substantially parallel to one another and are substantially perpendicular to fold lines 90, 92, and 94. Aperture 100 is positioned between fold lines 62 and 92 and is substantially bisected by fold line 90. Apertures 102, 104, and 106 are positioned at progressively larger distances from the central portion 50.

In one embodiment, the various fold lines described herein are creases in the planar member 48. However, cut lines that partially extend through the planar member 48 may also be used.

Still referring to FIG. 12, the end portions 56 and 58 extend from opposing ends (or sides) of the central portion 50 in directions substantially perpendicular to the extensions of the side portions 52 and 54 from the central portion 50 and are substantially rectangular in shape. As with the side portions 52 and 54, the end portions 56 and 58 are mirror images of and extend away from each other. The end portions 56 and 58 are connected to the central portion 50 of the planar member 48 at fold lines 108 and 110, respectively. In one embodiment, end portion 56 has flaps 112, 114, 116, and 118 extending therefrom at fold lines 120, 122, 124, and 126, respectively. Flap 112 and fold line 120 are opposite flap 118 and fold line 126, while flap 114 and fold line 122, as well as flap 116 and fold line 124, extend from end portion 56 opposite the central portion 50. In one embodiment, end portion 58 has flaps 128, 130, 132, and 134 extending therefrom at fold lines 136, 138, 140, and 142, respectively. Flap 128 and fold line 136 are opposite flap 134 and fold line 142, while flap 130 and fold line 138, as well as flap 132 and fold line 140, extend from end portion 58 opposite the central portion 50. As shown in FIG. 12, flaps 112 and 118 of end portion 56 and flaps 128 and 134 of end portion 58 have curved edges with a curvature similar to that of aperture 78 in side portion 52 and aperture 100 in side portion 54.

In one embodiment, fold lines 60, 62, 70, 92, 108, and 110 have one or more U-shaped slits 144 formed therein, which form fold line protrusion/slot pairs in the associated portions of the planar member 48. The U-shaped slits 144 allow the planar member 48 to be more precisely and crisply folded along each of the corresponding fold lines 60, 62, 70, 92, 108 and 110 especially where a thicker or more rigid material is used to form planar member 48. Additionally, flaps 114 and 116 of end portion 56 and flaps 130 and 132 of end portion 58 have flap protrusions 146 extending therefrom.

FIGS. 13-16 illustrate a series of operations performed on the planar member 48 shown in FIG. 12 in order to form, or assemble, the packaging assembly 20 shown in FIGS. 7-11. It should be noted that in FIGS. 13-16, for sake of clarity, only particular components (e.g., fold lines) relevant to the particular operation(s) performed may be visible. It should also be noted that FIG. 12 illustrates the planar member 48 in an initial planar, or "flat," configuration.

Figure 13:
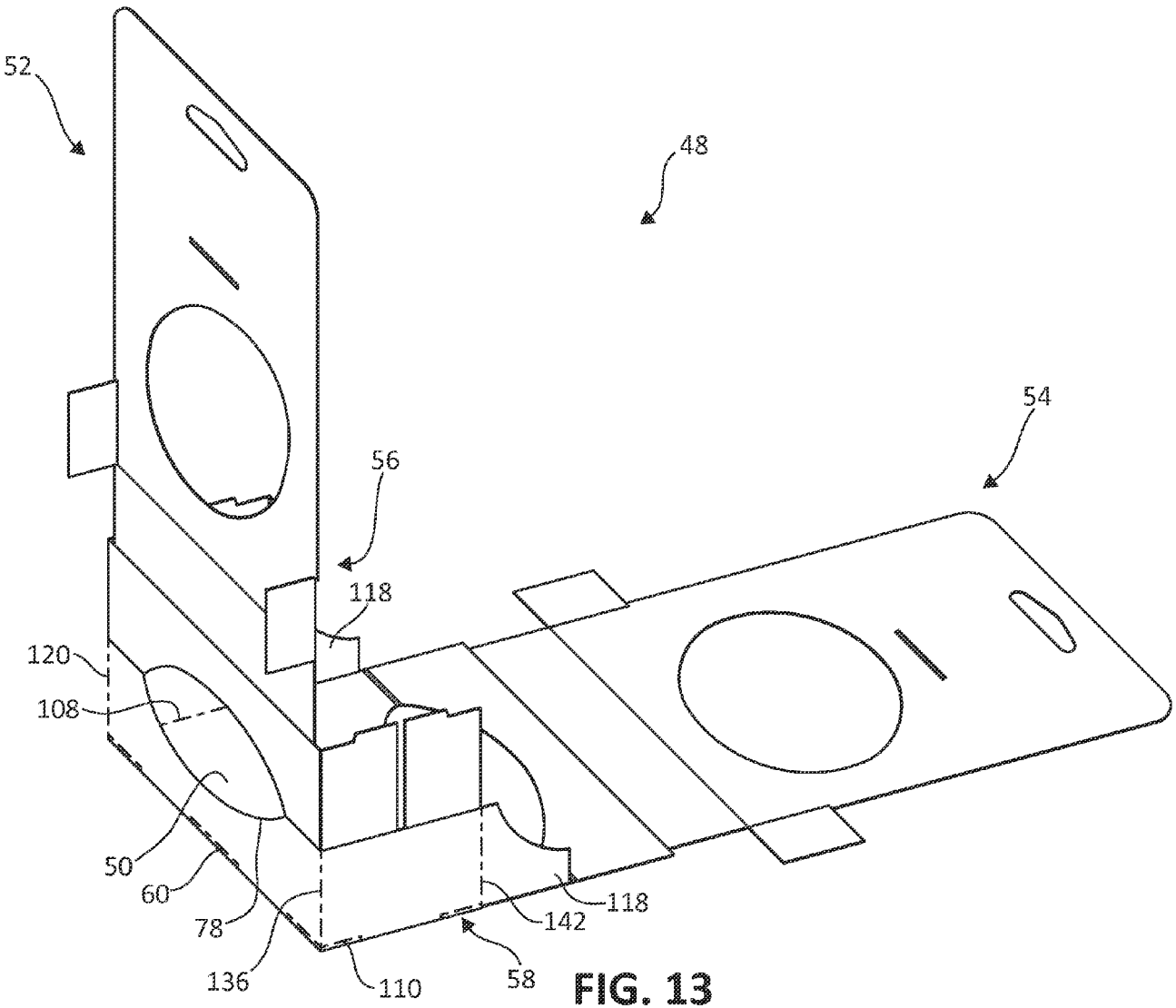
FIGS. 13-16 are front perspective views illustrating the integral planar member of FIG. 12 undergoing a series of operations to form the packaging assembly of FIG. 7, according to one embodiment of the present invention.

Referring to FIG. 13, in one embodiment, the assembly process begins with side portion 52 being folded "upwardly" (i.e., in the orientation shown in FIGS. 3-10) relative to the central portion 50 of the planar member 48 along fold line 60. The folding may be performed to such an extent that side portion 52 is substantially perpendicular to the central portion 50. As also indicated in FIG. 13, end portion 56 is folded upwardly along fold line 108, and end portion 58 is folded upwardly along fold line 110, in a manner similar to side portion 52.

Similarly, flap 112 of end portion 56 is folded inward along fold line 120, and flap 128 of end portion 58 is folded inward along fold line 136. As a result, in one embodiment, flaps 112 and 128 lay adjacent to side portion 52 such that the curved edges thereof are substantially congruent with lower portions of aperture 78 in side portion 52. Still referring to FIG. 13, similar to flaps 112 and 128, flap 118 of end portion 56 is folded inwardly along fold line 126, and flap 134 (not shown in FIG. 13) of end portion 58 is folded inwardly along fold line 142.

Figure 14:
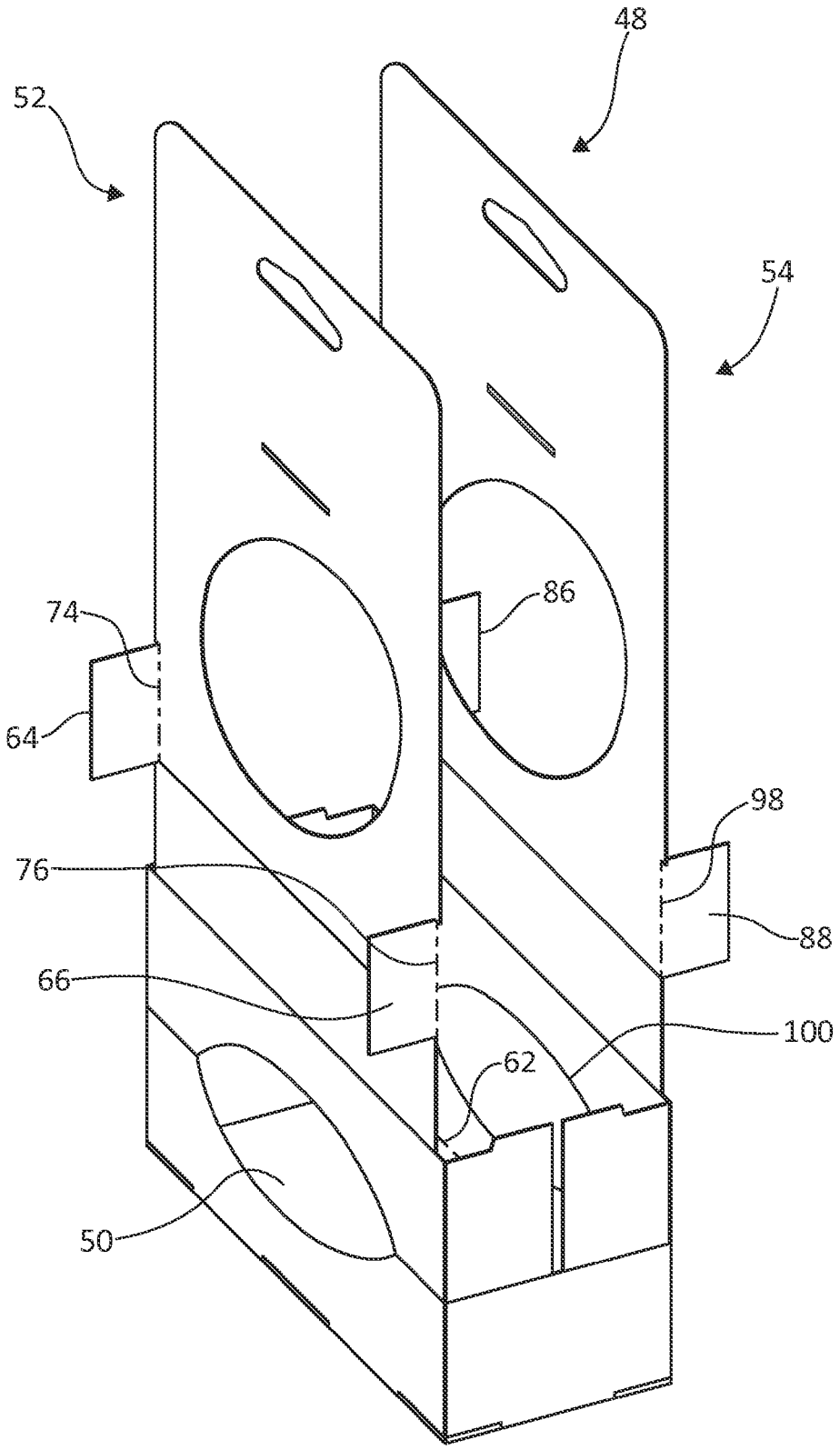

Then, as shown in FIG. 14, side portion 54 is folded upwardly along fold line 62. As a result, in one embodiment, flap 118 of end portion 56 and flap 134 of end portion 58 (shown in FIG. 12) lay adjacent to side portion 54 such that the curved edges thereof are substantially congruent with lower portions of aperture 100 in side portion 54. As also shown in FIG. 14, flaps 64 and 66 of side portion 52 are folded outwardly (i.e., away from the central portion 50 of the planar member 48) along fold lines 74 and 76, respectively. Likewise, flaps 86 and 88 of side portion 54 are folded outwardly along fold lines 96 (FIG. 12) and 98.

Figure 15:
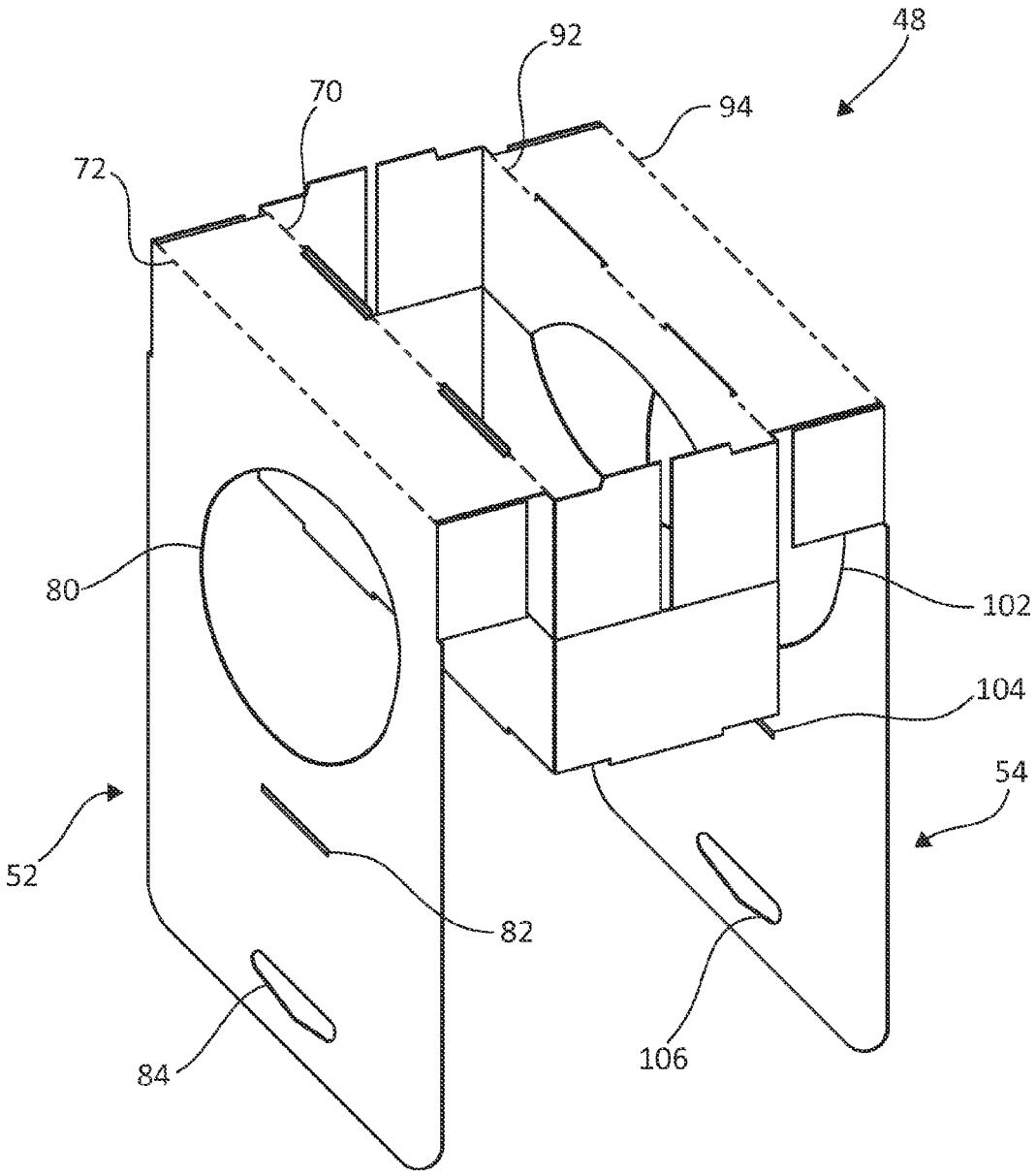

Referring now to FIG. 15, in one embodiment, two folds are made in each of the side portions 52 and 54. First, side portion 52 is folded outwardly along fold line 72, and side portion 54 is folded outwardly along fold line 94. Then, side portion 52 is folded outwardly along fold line 70, and side portion 54 is folded outwardly along fold line 92. As a result, in one example, the section of side portion 52 between fold lines 70 and 72 is substantially parallel to the central portion 50 (FIG. 14) of the planar member 48, and the section of side portion 52 having apertures 80, 82, and 84 is substantially perpendicular to the central portion 50 of the planar member 48. Likewise, in one embodiment, the section of side portion 54 between fold lines 92 and 94 is substantially parallel to the central portion 50 of the planar member 48, and the section of side portion 54 having apertures 102, 104, and 106 is substantially perpendicular to the central portion 50 of the planar member 48.

Figure 16:
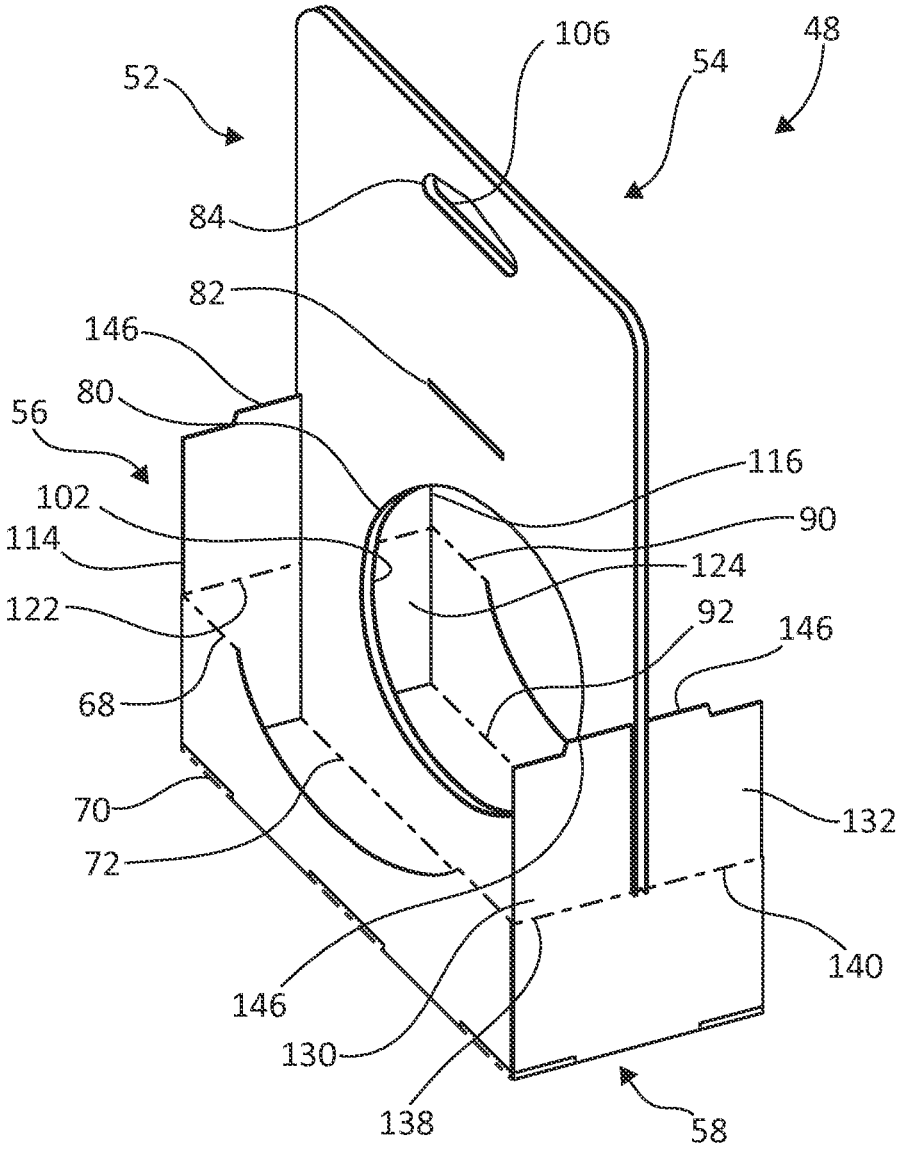

Then, as shown in FIG. 16, side portion 52 of the planar member 48 is folded inwardly (i.e., over the central portion 50, last shown in FIG. 14) along fold line 68, and side portion 54 of the planar member 48 is folded inwardly along fold line 90. As shown, in one embodiment, the folding along fold line 68 is performed to an extent such that the section of side portion 52 with apertures 80, 82, and 84 is substantially perpendicular to, and extends upwardly from, the central portion 50 (FIG. 14). Additionally, the section of side portion 52 between fold lines 70 and 72 is adjacent to the central portion 50. Likewise, in one example, the folding along fold line 90 is performed to an extent such that the section of side portion 54 with apertures 102, 104, and 106 is substantially perpendicular to, and extends upwards from, the central portion 50 and is adjacent to the section of side portion 52 with apertures 80, 82, and 84. Also, the section of side portion 54 between fold line 92 and fold line 94 (FIG. 15) is adjacent to the central portion 50.

Further, although not specifically shown, it should be understood that, in one embodiment, the protrusions formed by the U-shaped slits 144 (FIG. 12) in fold line 70 are inserted into, or mated with, the slots formed by the U-shaped slits 144 in fold line 60 (FIG. 12). Likewise, in one example, the protrusions formed by the U-shaped slits 144 in fold line 92 are inserted into the slots formed by the U-shaped slits 144 in fold line 62 (FIG. 12). It should be noted that the protrusions and slots may help secure the various portions of the planar member 48 in place after being folded as shown.

Referring to now to FIG. 16 in combination with FIG. 12, flaps 114 and 116 of end portion 56 and flaps 130 and 132 of end portion 58 are then folded inwardly. Specifically, flaps 114 and 116 are folded along fold lines 122 and 124, respectively, such that the protrusions 146 thereon are inserted into the slot formed by the U-shaped slit 144 in fold line 108. In a similar manner, flaps 130 and 132 are folded along fold lines 138 and 140, respectively, such that the protrusions 146 thereon are inserted into the slot formed by the U-shaped slit 144 in fold line 110.

After the folding of flaps 114, 116, 130, and 132, the planar member 48 resembles the packaging assembly 20 shown in FIGS. 7-11, and, in one embodiment, is fully formed without using any fasteners, etc. formed separately from the planar member 48. As is evident from the description above and FIGS. 7-16, the base 22, including side walls 28 and 30 and end walls 32 and 34, of the packaging assembly 20 is formed from the central portion 50 of the planar member 48, the section of side portion 52 between fold line 60 and fold line 72, the section of side portion 54 between fold line 62 and 94, end portion 56, and end portion 58. The divider 24 of the packaging assembly 20 is formed from the section of side portion 52 having apertures 80, 82, and 84 and the section of side portion 54 having apertures 102, 104, and 106 positioned back to back. It should also be noted that after side portions 52 and 54 have been completely folded, apertures 80, 82, and 84 are aligned with apertures 102, 104, and 106, respectively, to form the corresponding openings 42, 44, and 46 through the divider 24, as shown in FIG. 1.

After the formation of the packaging assembly 20, the products 12, 14, 16, and 18 (FIG. 1) may be positioned within the product receptacle 36 (FIG. 7), on both sides of the divider 24 (i.e., within both of the chambers of the product receptacle 36). In one embodiment, the band 21 shown in FIG. 1-6 may be inserted through the opening 44 in the divider 24 (FIG. 7) and wrapped around the products 12, 14, 16, and 18 and the base 22 to secure the products 12, 14, 16, and 18 to the packaging assembly 20 and/or within the product receptacle 36. In one embodiment, for example, where the products 12, 14, 16, and 18 each define a protruding central portion 170 (FIGS. 3, 4, and 6), the protruding central portion 170 of one of the products 12, 14, 16, and 18, for example, the product 14, fits and is positioned within the opening 42 in the divider 24, to decrease the overall width of product assembly 10 as measured from between opposing outer surfaces of the side walls 28 and 30 (FIGS. 7-11). Accordingly, in one example, the opening 42 is shaped similarly to and sized slightly larger than the protruding central portion 170 of the product 14. The packaging assembly 20, as well as the products, may then be suspended from a hanger (e.g., on a sales rack) that is inserted through opening 46 through the divider, or hanging member, 24.

Figure 17:
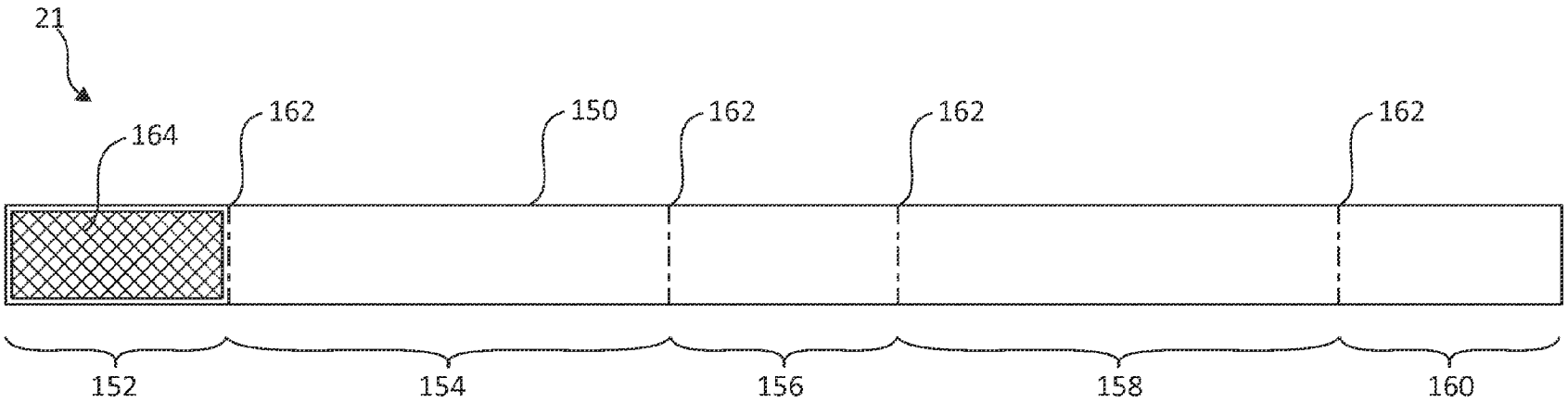
FIG. 17 is a top view of a band within the product assembly of FIG. 1, according to one embodiment of the present invention.

FIG. 17 illustrates the band 21 in greater detail, according to one embodiment of the present invention. The band 21 includes a substantially flat, elongate body 150 made of, for example, a translucent or transparent plastic. However, other materials may be used, such as a ribbon. In the example shown, the body 150 includes five sections 152, 154, 156, 158, and 160 separated by fold lines 162. As shown, sections 152, 156, and 160 have similar lengths, as do sections 154 and 158. In one embodiment, sections 154 and 158 are substantially longer than sections 152, 156, and 160. The band 21 also includes an adhesive pad (or simply an adhesive) 164 deposited on the upper surface (as shown in FIG. 17) of section 162 of the body 150.

Figure 7:
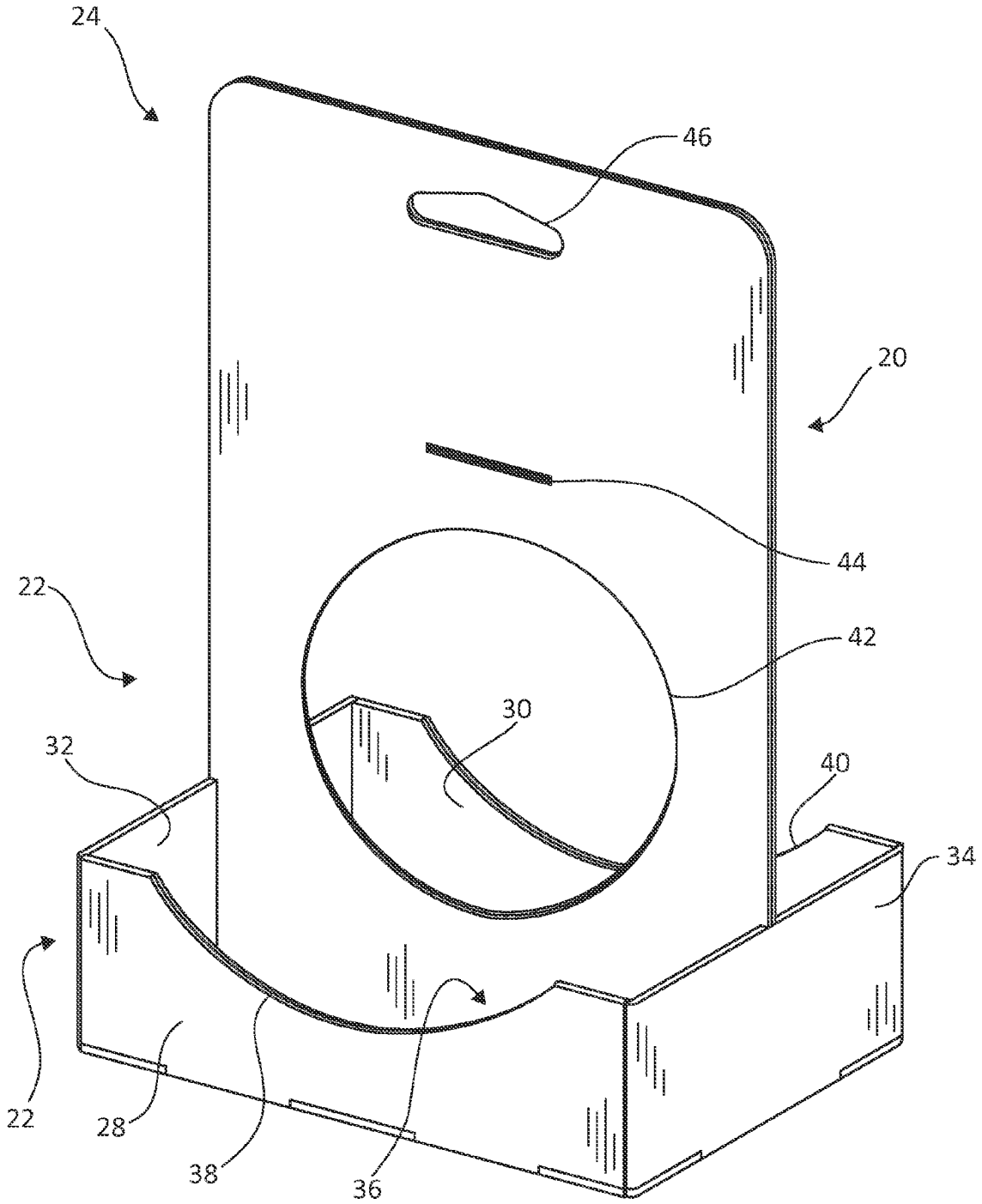
FIG. 7 is a front, perspective view illustrating a packaging assembly within the product assembly of FIG. 1, according to one embodiment of the present invention.
Figure 8:
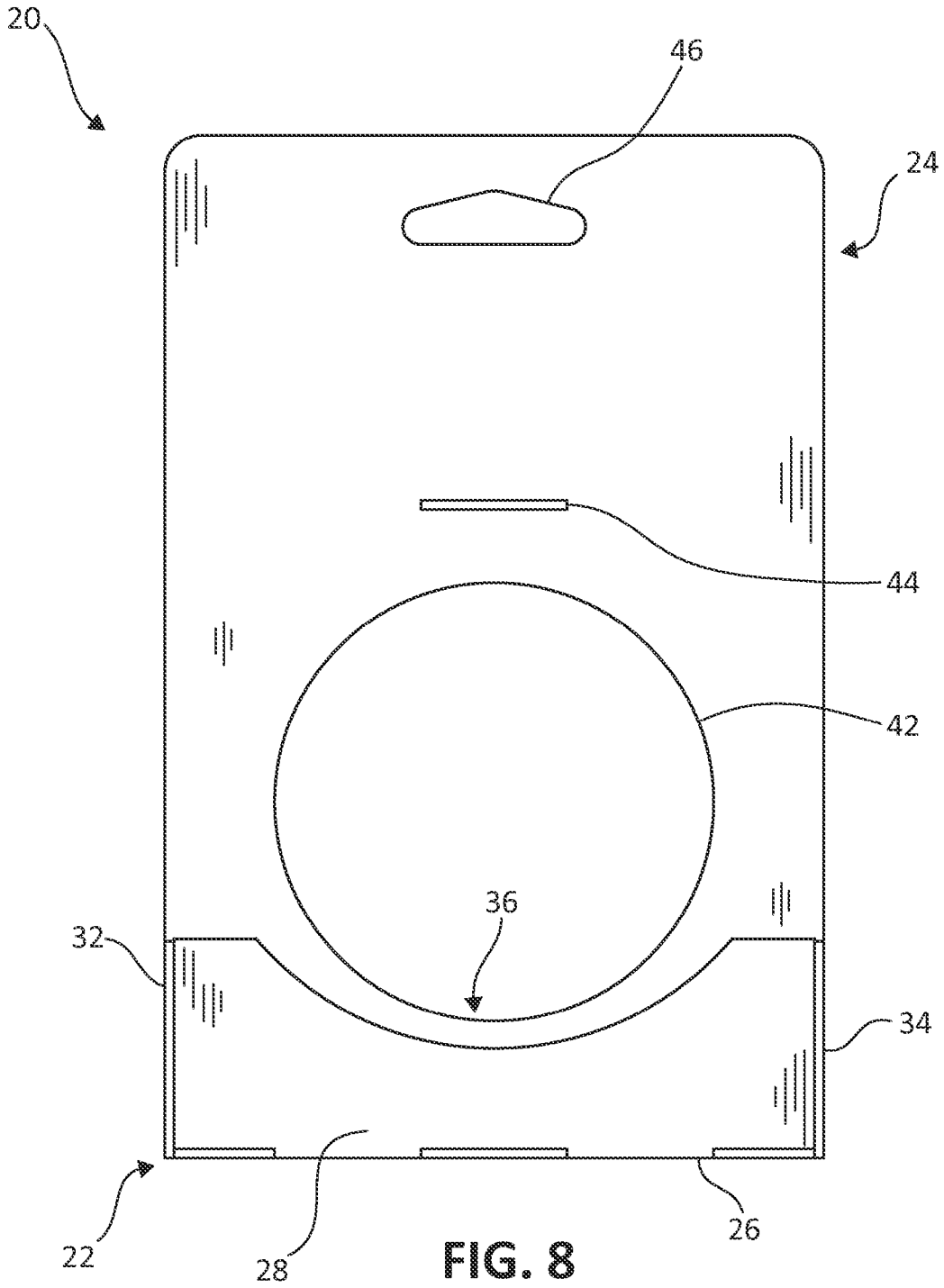
FIG. 8 is a front view of the packaging assembly of FIG. 7, the back view being identical to the front view.
Figure 9:
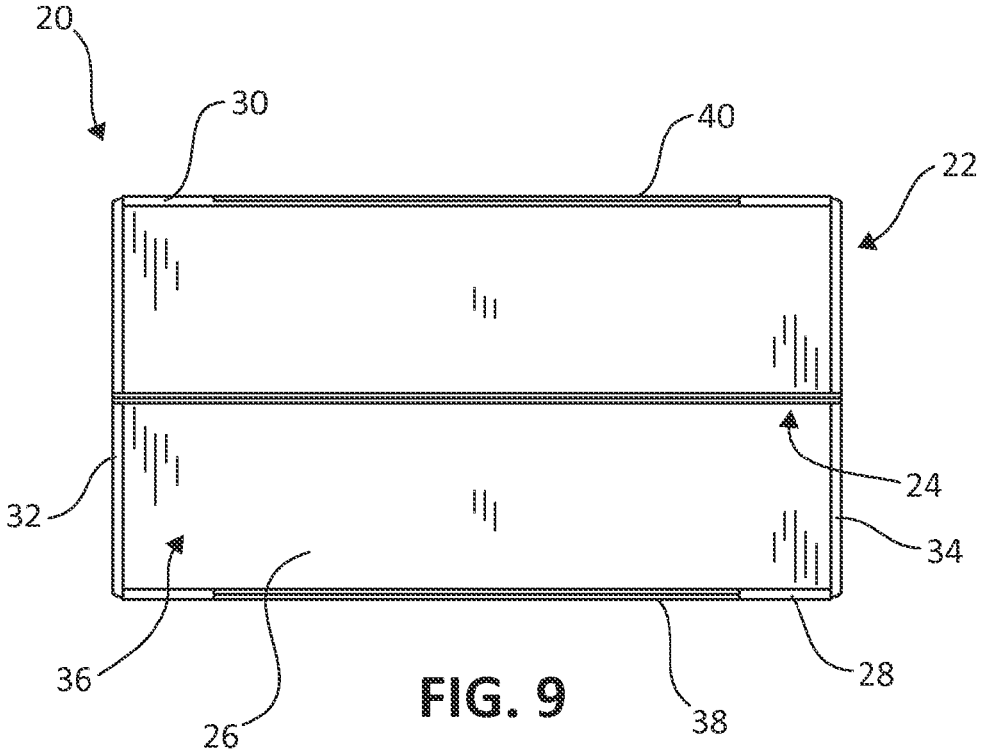
FIG. 9 is a top view of the packaging assembly of FIG. 7.
Figure 10:
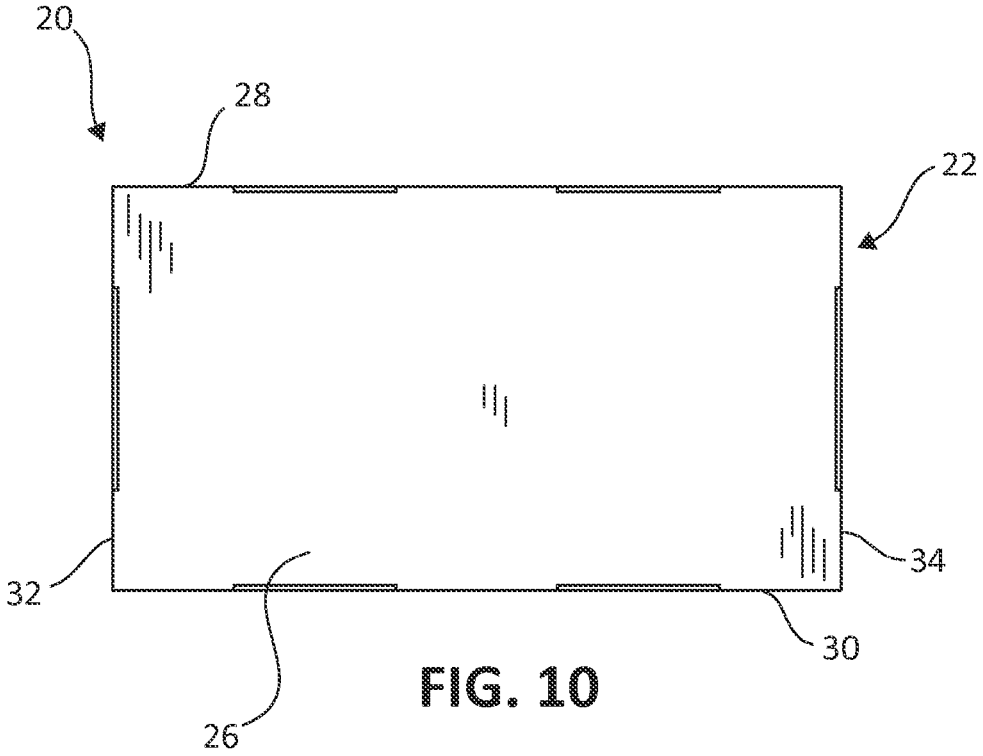
FIG. 10 is a bottom view of the packaging assembly of FIG. 7.
Figure 11:
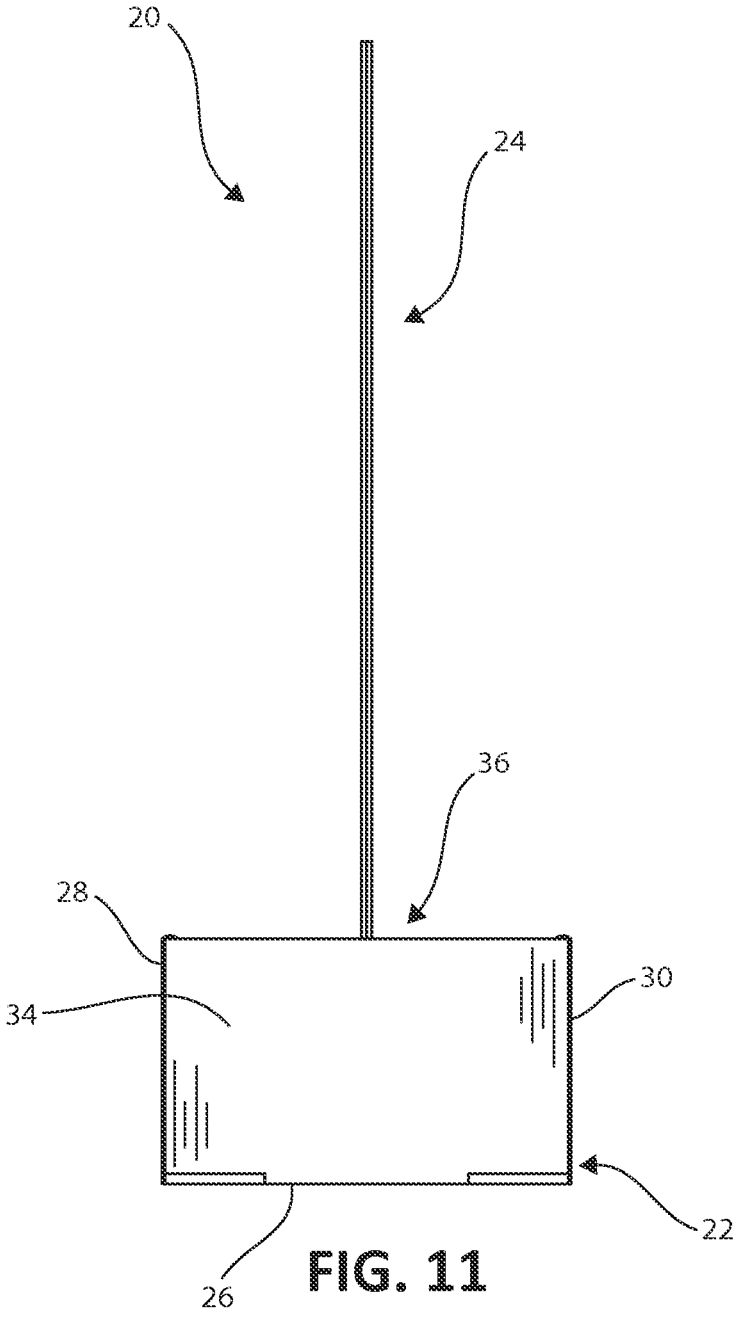
FIG. 11 is a right side view of the packaging assembly of FIG. 7, the left side view being a mirror image thereof.

When the band 21 is inserted through the opening 44 through the divider 24 (FIG. 7) and wrapped around the base 22, the adhesive pad 164 is used to fasten section 164 of the body 150 to section 160 of the body 150, which, in one embodiment, overlap on the underside of the base 22 of the packaging assembly 20 (FIG. 7). As such, the products 12, 14, 16, and 18 are secured between the bottom piece 26 of the base 22 and section 156 (i.e., a top section) of the body. The use of other suitable fasteners to secure section 164 of the body 150 to section 160 of the body 150 is also contemplated and will be apparent to those of skill in the art upon reading this description. Further, in one example, section 156 corresponds to the portion of the body 150 that is positioned through opening 44 and on an upper side of the products 12, 14, 16, and 18 as shown in FIG. 1. Further, in one example, sections 154 and 158 extend along the sides of the products 12, 14, 16, and 18 and are arranged substantially parallel to the divider 24.

Figure 18:
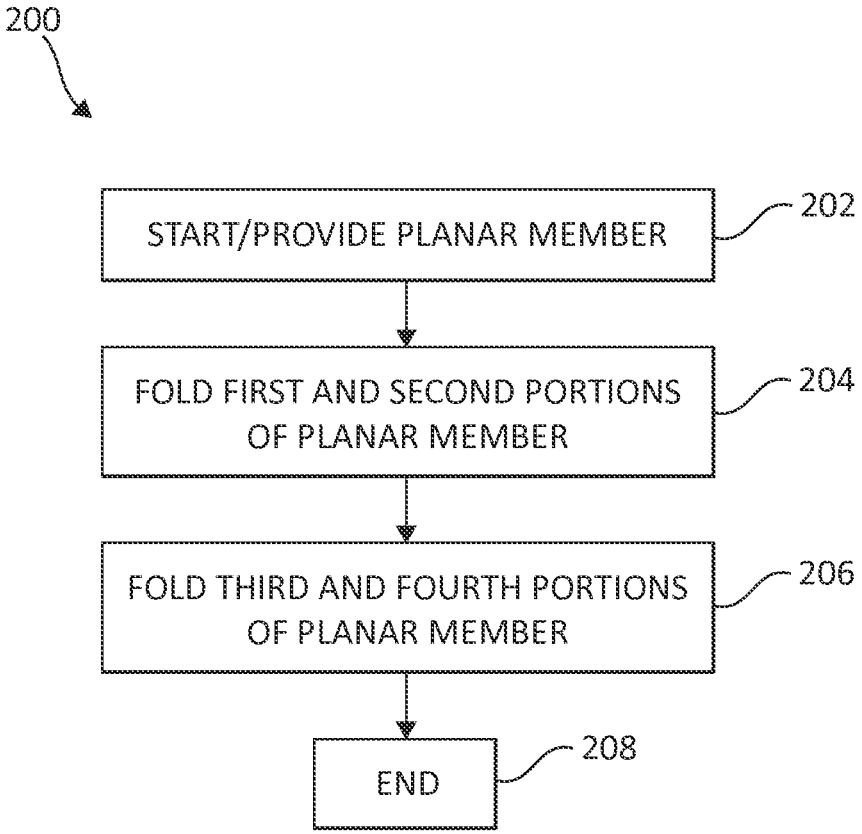
FIG. 18 is a flow chart illustrating a method of forming the packaging assembly of FIG. 7 with an integral planar member, according to one embodiment of the present invention.

FIG. 18 is a flow chart generally illustrating a method 200 for forming a packaging assembly, such as packaging assembly 20 described above, according to one embodiment of the present invention. At 202, the method begins with an integral planar member (e.g., the planar member 48 described above) made of, for example, cardboard being provided. The integral planar member has a central portion (e.g., the central portion 50 in FIG. 2 and/or the bottom piece 26 of the base 22 in FIG. 1) and first, second, third, and fourth folding portions extending from the central portion. In one embodiment, the first and second folding portions of the planar member correspond to the side portions 52 and 54 (FIG. 2), and the third and fourth folding portions of the integral planar member correspond to the end portions 56 and 58.

At 204, the first and second portions of the integral planar member are folded toward the central portion of the integral planar member. After folding, the first and second portions form a divider (e.g., the divider 24 in FIG. 1) extending upwardly from the central portion. The first and second portions also at least partially form first and second walls (e.g., the side walls 28 and 30 in FIG. 1) extending upwardly from opposing sides of the central portion.

At 206, the third and fourth portions of the planar member are folded toward the central portion. After folding, the third and fourth portions of the planar member at least partially form third and fourth walls (e.g., the end walls 32 and 34) extending upwardly from opposing sides of the central portion.

The central portion of the planar member and the first, second, third, and fourth walls form a receptacle (e.g., base 22 and/or product receptacle 36 in FIG. 1), which is divided into two portions by the divider. The receptacle and the divider jointly form a packaging assembly, such as the packaging assembly 20 shown in FIGS. 7-11. The method ends at 208. Once the packaging assembly is formed per method 200, in one embodiment, products (e.g., the products 12, 14, 16, and 18 in FIGS. 1-6) are placed into the receptacle and, in one embodiment, are secured with a band (e.g., the band 21 of FIGS. 1-6 and 17) or other member, and are displayed along with the packaging assembly for retail sale in a retail environment.

It should be understood that the method 200 depicted in FIG. 18 may include additional steps and details, such as those described above and shown in FIGS. 13-16. It should also be understood that the method 200 is one example of assembling a packaging assembly and variations will be apparent to those of skill in the art upon reading this application.

Although the invention has been described to particular embodiments, such embodiments are for illustrative purposes only and should not be considered to limit the invention. Various alternatives and modifications within the scope of the invention in its various embodiments will be apparent to those with ordinary skill in the art.

What is claimed is:

1. A packaging assembly comprising:

a base having a bottom piece and first, second, third, and fourth walls extending from the bottom piece, the bottom piece and the first, second, third, and fourth walls defining a product receptacle;

a divider connected to the bottom piece of the base and extending through the product receptacle, wherein the divider comprises at least one enclosed opening extending through an interior portion of the divider; and a band extending through the at least one enclosed opening and around the base;

wherein the base and the divider are jointly formed from an integral planar member having a plurality of folds therein.

2. The packaging assembly of claim 1, wherein the integral planar member comprises a central portion and first, second, third, and fourth folding portions extending from a periphery of the central portion.

3. The packaging assembly of claim 2, wherein the first and second folding portions of the integral planar member are folded toward the central portion of the integral planar member to jointly form the divider.

4. The packaging assembly of claim 2, wherein the first folding portion of the integral planar member includes an aperture extending substantially symmetrically on either side of a fold line such that the when the first folding portion is folded along the fold line to form a top edge of the first wall of the base, perimeter edges of the aperture are positioned immediately adjacent each other to define a depression along the top edge of the first wall.

5. The packaging assembly of claim 3, wherein the first folding portion of the integral planar member at least partially forms the first wall of the base, and the second folding portion of the integral planar member at least partially forms the second wall of the base.

6. The packaging assembly of claim 5, wherein the third and fourth folding portions of the integral planar member are folded toward the central portion of the integral planar member such that the third folding portion of the integral planar member at least partially forms the third wall of the base and the fourth folding portion of the integral planar member at least partially forms the fourth wall of the base.

7. The packaging assembly of claim 6, wherein the first and second walls of the base extend from opposing sides of the bottom piece, the first and second folding portions of the integral planar member extend from opposing sides of the central portion of the integral planar member, the third and fourth walls of the base extend from opposing sides of the bottom piece, and the third and fourth folding portions of the integral planar member extend from opposing sides of the central portion of the integral planar member.

8. The packaging assembly of claim 5, wherein the first folding portion of the integral planar member at least partially forms the bottom piece of the base, and the second folding portion of the integral planar member at least partially forms the bottom piece of the base.

9. The packaging assembly of claim 8, wherein the divider divides the product receptacle into two substantially equal portions.

10. The packaging assembly of claim 9, wherein the divider is substantially parallel to and spaced from each of the first and second walls of the base.

11. The packaging assembly of claim 1, in combination with products positioned within the product receptacle between each of the divider and the first wall and the divider and the second wall, wherein the band extends around the products to secure the products between the bottom piece of the base and a top section of the band.

12. The packaging assembly of claim 11, wherein the products provided in combination thereof extend above top edges of the base and are exposed above the top edges of the base on either side of the divider.

13. The packaging assembly of claim 11, wherein:

at least one of the products provided in combination thereof includes a protruding portion, the divider includes a hole therethrough having outer dimensions at least as large as the protruding portion of the at least one of the products, and the at least one of the products is positioned adjacent the divider such that the protruding portion of the at least one of the products is positioned within the hole of the divider.

14. The packaging assembly of claim 1, wherein the divider extends upwardly from the bottom piece of the base a distance that is at least twice a distance that any one of the first wall, the second wall, the third wall, and the fourth wall extends upwardly from the bottom piece of the base.

15. A product container comprising:

a sheet of material having a central portion, side portions extending from opposing sides of the central portion, and end portions extending from opposing ends of the of the central portion, wherein:

the side portions are folded toward the central portion to jointly form a hanging member substantially extending from the central portion and at least partially form side walls on the opposing sides of the central portion, each of the side walls is formed of a double thickness of the sheet of material, each thickness of the sheet of material forming a corresponding one of the side walls is separated from the other thickness of the sheet material forming the corresponding side wall by a fold line along a top edge of the corresponding one of the side walls, an aperture is formed in the sheet of material and bisected by the fold line such that when the sheet of material is folded along the fold line opposing edges of the aperture align to form a depression in the top edge of the corresponding one of the side walls, and the end portions are folded toward the central portion to at least partially form end walls on the opposing ends of the central portion, the central portion of the sheet of material, the side walls, and the end walls jointly forming a carton through which the hanging member extends.

16. The product container of claim 15, wherein the carton comprises a bottom piece, the central portion of the sheet of material at least partially forms the bottom piece of the carton, the side walls extend from opposing sides of the bottom piece of the carton, and the end walls extend from opposing ends of the bottom piece of the carton.

17. The product container of claim 16, wherein the side portions of the sheet of material at least partially form the bottom piece of the carton.

18. The product container of claim 16, wherein the hanging member is substantially perpendicular to the bottom piece of the carton and the end walls and is substantially parallel to the side walls.

19. The product container of claim 18, wherein the hanging member comprises at least one opening extending therethrough.

20. A product assembly comprising:

a product container comprising:

a sheet of material having a central portion, side portions extending from opposing sides of the central portion, and end portions extending from opposing ends of the of the central portion, wherein:

the side portions are folded toward the central portion to jointly form a hanging member substantially extending from the central portion and at least partially form side walls on the opposing sides of the central portion, each of the side walls is formed of a double thickness of the sheet of material, each thickness of the sheet of material forming a corresponding one of the side walls is separated from the other thickness of the sheet material forming the corresponding side wall by a fold line along a top edge of the corresponding one of the side walls, an aperture is formed in the sheet of material and bisected by the fold line such that when the sheet of material is folded along the fold line opposing edges of the aperture align to form a depression in the top edge of the corresponding one of the side walls, and the end portions are folded toward the central portion to at least partially form end walls on the opposing ends of the central portion, the central portion of the sheet of material, the side walls, and the end walls jointly forming a carton through which the hanging member extends; and a plurality of products maintained within the product container on either side of the hanging member, wherein:

the hanging member defines a hole extending therethrough, and during use of the product container, at least one of the plurality of products includes a protruding section that is positioned immediately adjacent the hanging member and extends through the hole defined by the hanging member.

21. The product assembly of claim 20, wherein:

the hanging member comprises an enclosed opening extending through an interior portion of the hanging member, and the product container further comprises a band extending through the enclosed opening, around the plurality of products, and around the side walls to maintain the plurality of products within the product container.

* * * * *